US008950386B2

(12) United States Patent
Hedberg

(10) Patent No.: US 8,950,386 B2
(45) Date of Patent: Feb. 10, 2015

(54) BALL FEEDING ARRANGEMENT

(75) Inventor: Daniel Hedberg, Varing (SE)

(73) Assignee: Daniel Hedberg Development AB, Varing (SE)

( * ) Notice: Subject to any disclaimer, the term of this patent is extended or adjusted under 35 U.S.C. 154(b) by 12 days.

(21) Appl. No.: 13/980,219

(22) PCT Filed: Jan. 23, 2012

(86) PCT No.: PCT/EP2012/050954

§ 371 (c)(1),
(2), (4) Date: Nov. 7, 2013

(87) PCT Pub. No.: WO2012/101082

PCT Pub. Date: Aug. 2, 2012

(65) Prior Publication Data

US 2014/0053821 A1 Feb. 27, 2014

(30) Foreign Application Priority Data

Jan. 24, 2011 (EP) ..... 11151846

(51) Int. Cl.
*F41B 11/53* (2013.01)
*F41B 11/57* (2013.01)
*F41B 11/52* (2013.01)

(52) U.S. Cl.
CPC ..... *F41B 11/53* (2013.01); *F41B 11/57* (2013.01); *F41B 11/52* (2013.01)
USPC ..... 124/51.1; 124/48; 124/49; 221/258; 221/277

(58) Field of Classification Search
CPC ..... F41B 11/52; F41B 11/57; F41B 11/53
USPC ..... 124/48, 49, 51.1; 221/258, 277
See application file for complete search history.

(56) References Cited

U.S. PATENT DOCUMENTS 5,816,232 A * 10/1998 Bell ..... 124/51.1
6,213,110 B1 * 4/2001 Christopher et al. ..... 124/51.1

(Continued)

FOREIGN PATENT DOCUMENTS

EP 1 653 189 A1 5/2006
WO WO-2009/009748 A1 1/2009

OTHER PUBLICATIONS

International Search Report for PCT/EP2012/050954, mailed Apr. 10, 2012; ISA/EP.

*Primary Examiner* — Gene Kim
*Assistant Examiner* — Alexander Niconovich
(74) *Attorney, Agent, or Firm* — Harness, Dickey & Pierce, P.L.C.

(57) ABSTRACT

A ball feeding arrangement (101) comprising: a rotor element (123) for pushing a ball (145); a transmission element (127) connected to the rotor element; and a drive element (130) for driving a rotational movement of the rotor element (123) via the transmission element (127), which drive element (130) is intended to be driven by a drive motor (122), wherein one of the drive element (130) and the transmission element (127) has at least one protrusion (140; 140*a-b*), and the other of the drive element and the transmission element (127) has a guiding surface (133) adapted to guide the at least one protrusion (140; 140*a-b*) during relative rotation between the drive element (130) and the transmission element (127), wherein the at least one protrusion (140; 140*a-b*) is yieldingly biased against the guiding surface (133), wherein the biasing force, a shape of the guiding surface (133) and a shape of the at least one protrusion are adapted to enable transfer of a rotational force of a given magnitude from the drive element (130) to the transmission element (127) such that a relative rotation between the drive element (130) and the transmission element (127) occurs when the rotor element (123) is subject to a rotational resistance greater than the given magnitude, wherein the biasing force, a shape of the guiding surface (133) and a shape of the at least one protrusion (140; 140*a-b*) are further adapted such that, occasionally during relative rotation between the drive element (130) and the transmission element (127), a pressure is generated between the at least one protrusion (140; 140*a-b*) and the guiding surface (133) that urges the transmission element (127) to rotate in a rotational direction opposite a rotational direction of the drive element (130).

13 Claims, 10 Drawing Sheets

(56) References Cited

U.S. PATENT DOCUMENTS

| | | | | |
|---|---|---|---|---|
| 6,502,567 | B1 * | 1/2003 | Christopher et al. | 124/51.1 |
| 6,701,907 | B2 * | 3/2004 | Christopher et al. | 124/48 |
| 6,889,680 | B2 * | 5/2005 | Christopher et al. | 124/51.1 |
| 7,343,909 | B2 * | 3/2008 | Christopher et al. | 124/51.1 |
| 7,357,130 | B2 * | 4/2008 | Broersma | 124/51.1 |
| 7,445,002 | B2 * | 11/2008 | Christopher et al. | 124/51.1 |
| 7,654,255 | B2 * | 2/2010 | Spicer | 124/51.1 |
| 7,832,389 | B2 * | 11/2010 | Christopher | 124/51.1 |
| 7,854,220 | B1 * | 12/2010 | Neumaster | 124/51.1 |
| 8,047,191 | B2 * | 11/2011 | Christopher et al. | 124/51.1 |
| 8,104,462 | B2 * | 1/2012 | Christopher et al. | 124/51.1 |
| 8,118,016 | B2 * | 2/2012 | Italia et al. | 124/51.1 |
| 8,251,050 | B2 * | 8/2012 | Christopher et al. | 124/51.1 |
| RE43,756 | E * | 10/2012 | Christopher et al. | 124/51.1 |
| 8,356,589 | B2 * | 1/2013 | Karnis | 124/48 |
| 8,387,607 | B2 * | 3/2013 | Christopher et al. | 124/51.1 |
| 8,402,959 | B1 * | 3/2013 | Nungester | 124/51.1 |
| 8,459,245 | B1 * | 6/2013 | Fiorill et al. | 124/51.1 |
| 8,561,600 | B2 * | 10/2013 | Christopher et al. | 124/51.1 |
| 8,746,225 | B2 * | 6/2014 | Christopher et al. | 124/51.1 |
| 2004/0074489 | A1 * | 4/2004 | Neumaster et al. | 124/79 |
| 2006/0086347 | A1 * | 4/2006 | Hedberg | 124/51.1 |

* cited by examiner

BALL FEEDING ARRANGEMENT

CROSS-REFERENCE TO RELATED APPLICATIONS

This application is a 371 U.S. National Stage of International Application No. PCT/EP2012/050954, filed on Jan. 23, 2012, which claims priority to European Patent Application No. 11151846.0, filed Jan. 24, 2011, the contents of which are hereby incorporated by reference in their entirety as if fully set forth herein.

TECHNICAL FIELD

The present invention relates to a ball feeding arrangement comprising a rotor element for pushing a ball, and to a paint ball loader comprising such a ball feeding arrangement.

BACKGROUND OF THE INVENTION

Ball feeding arrangements may be used in a variety of applications, such as for feeding ball-shaped objects in an industrial process, or for feeding projectiles to a firing chamber in a compressed gas driven weapon. An example of a ball feeding arrangement is a loading mechanism in a paintball gun.

U.S. Pat. No. 6,502,567 describes a paintball loader comprising a paintball container and a fin device of circular shape which is driven with a rotational movement by a drive motor via an axle shaft that is upwardly directed and coupled to the rotational centre of the fin device. The paintballs are pushed by the rotation of the fins of the fin device and are consequently pressed forward and outward from the rotational centre by the centrifugal force. An outlet tube is connected to the paintball container with its input opening located in the outer wall of the container. Thus, the rotational speed of the fin device presses the paintballs into the opening of the outlet tube and into the paintball marker.

EP 1 653 189 describes an alternative paintball loader comprising a rotor body having at least one rotor fin, and a drive motor for rotating the rotor body in a first direction. The paintball loader has a central outlet located radially inwards of the tip of the rotor fin and an abutment body arranged to interact with the at least one rotor fin. When the rotor body is rotated, a paintball, located in a space formed between the at least one rotor fin and the abutment body, is pushed out of the paintball loader through the central outlet.

However, occasionally a jam may occur when one or more balls get stuck and block the movement of the rotor element that pushes the balls so that the feeding of balls is interrupted. The jam may also cause fragile balls, such as paintballs, to break when they are squeezed by the rotor element. Additionally, the drive motor may be damaged as the rotational resistance exceeds the strength of the drive motor.

SUMMARY OF THE INVENTION

In view of the above, an object of the invention is to alleviate at least one of the problems discussed above. In particular, an object is to alleviate the problem with jams in ball feeding arrangements.

According to an aspect of the invention, there is provided a ball feeding arrangement comprising:

a rotor element for pushing a ball;

a transmission element connected to the rotor element; and a drive element for driving a rotational movement of the rotor element via the transmission element, which drive element is intended to be driven by a drive motor, wherein one of the drive element and the transmission element has at least one protrusion, and the other of the drive element and the transmission element has a guiding surface adapted to guide the at least one protrusion during relative rotation between the drive element and the transmission element, wherein the at least one protrusion is yieldingly biased against the guiding surface, wherein the biasing force, a shape of the guiding surface, and a shape of the at least one protrusion are adapted to enable transfer of a rotational force of a given magnitude from the drive element to the transmission element such that a relative rotation between the drive element and the transmission element occurs when the rotor element is subject to a rotational resistance greater than the given magnitude, wherein the biasing force, the shape of the guiding surface and the shape of the at least one protrusion is further adapted such that, occasionally during relative rotation between the drive element and the transmission element, a pressure is generated between the at least one protrusion and the guiding surface that urges the transmission element to rotate in a rotational direction opposite a rotational direction of the drive element.

To allow reliable feeding of balls, the given magnitude preferably exceeds the rotational resistance that is experienced by the transmission element when balls that are free to move are being pushed. Further, the strength of the drive motor preferably exceeds the given magnitude such that relative rotation between the drive element and the transmission element occurs when the rotor element is blocked.

The present invention is based on the realization that by adapting the biasing force, the shape of the guiding surface, and the shape of the at least one protrusion such that a relative rotation between the drive element and the transmission element occurs when the transmission element is subject to a rotational resistance greater than a given magnitude, and such that, occasionally during relative rotation between the drive element and the transmission element, a pressure is generated between the at least one protrusion and the guiding surface that urges the transmission element to rotate in a rotational direction opposite a rotational direction of the drive element the pressure on the ball is reduced when a ball gets stuck. This variation in pressure may cause the ball to shift position and be set free thereby reducing the risk of a jam. If the biasing force is sufficiently strong, a surface (e.g. a rotor fin) on the rotor element that pushes the ball may even move away from the squeezed ball, further increasing the chances that the ball is set free. Further, as only a limited rotational force can be transferred to the rotor element, one may avoid that fragile balls, such as paintballs, break. Additionally, as the drive element may continue to rotate when the rotor element is blocked, a jam is less detrimental to the drive motor.

The transmission element is connected to the rotor element in such a way that rotation of the transmission element generates a rotational movement of the rotor element. This can be achieved in a variety of ways. For instance, if the rotor element and the transmission element are rotatable about a common rotational axis, the transmission element can be fastened to the rotor element, or the transmission element may be an integral part of the rotor element. As the number of moving part is reduced, it enables a more reliable construction that can be produced at a lower cost. However, the rotational axis of the rotor element may also be separated from the rotational axis of the transmission element. In this case, the transmission element can be coupled to the rotor element by means of e.g. cog wheels, or a transmission belt that transfers the rotational movement of the transmission element to the rotor element.

The guiding surface may include at least one first surface inclined in such a way that rotation of the drive element generates a pressure between the at least one protrusion and the at least one first surface that urges the transmission element to rotate in the rotational direction of the drive element.

The guiding surface may include at least one second surface inclined in such a way that the biasing force generates a pressure between the at least one protrusion and the at least one second surface that urges the transmission element to rotate in a rotational direction opposite the rotational direction of the drive element. Thereby the pressure on the ball is further reduced. If the biasing force is sufficiently strong, a surface (e.g. a rotor fin) on the rotor element that pushes the ball may even move away from the squeezed ball, further increasing the likelihood that the ball is set free.

The at least one first surface and the at least one second surface may be arranged in such a way that the protrusions alternately are biased against one of said first surfaces and one of said second surfaces during relative rotation between said drive element and said transmission element. Thereby the pressure on the squeezed ball varies during relative rotation between the drive element and the transmission element.

The ball feeding arrangement may further comprise a resilient structure arranged to yieldingly bias the at least one protrusion against the guiding surface. The resilient structure may be implemented in a variety of ways. For instance, the resilient structure may include a spring, a pair of repelling magnetic elements, or any other suitable resilient element arranged in such a way that the at least one protrusion is yieldingly biased against the guiding surface. Also, the at least one protrusion (and/or the guiding surface) may form a resilient structure e.g. by using a protrusion (and/or a guiding surface) of a flexible material and adapt the flexible protrusion (and/or the guiding surface) such that the protrusion is biased against the guiding surface. An advantage with a resilient structure is that an increased biasing force can be achieved. However, it is noted that such a resilient structure is not required to yieldingly bias the protrusion against the guiding surface. For instance, the gravitational force may be sufficient to yieldingly bias the protrusion against the guiding surface.

According to an embodiment, a second guiding surface may be arranged such that there is a guiding surface on either side of the protrusion. This can be achieved, for example, by guiding the protrusion in a groove, or channel.

The guiding surface may have an oscillating shape, or a wave-shape. For instance, the guiding surface may have a shape that resembles a sine wave, a triangle wave, or a saw tooth wave. An advantage with an oscillating shape is that the inclination of the guiding surface is reversed at each maxima (and minima). Thus, as the at least one protrusion is guided along the oscillating guiding surface, a pressure is generated between the protrusion and the guiding surface that alternately urges the transmission element to rotate in the rotational direction of the drive element, and alternately urges the transmission element to rotate in a rotational direction opposite the rotational direction of the drive element.

The guiding surface may have a variation in a direction substantially parallel to the rotational axis. Thus, the guiding surface may oscillate about a plane substantially perpendicular to a rotational axis of the drive element, such that a distance to the plane varies along the guiding surface. Or put differently, the amplitude of the oscillation may be in an axial direction, i.e. a direction parallel with the rotational axis.

The guiding surface may be such that a distance to the rotational axis of the drive element varies along the guiding surface. Thus, the guiding surface may oscillate in a plane substantially perpendicular to the rotational axis such that the amplitude of the oscillation is in a radial direction (i.e. a direction perpendicular to the rotational axis).

The transmission element and the drive element may be rotatable about a common rotational axis.

The guiding surface may form a closed, preferably continuous, path. For example, the guiding surface may form a substantially circular path.

A distance between adjacent protrusions may correspond to one or more complete cycles of the oscillating guiding surface. Thereby all protrusions can simultaneously follow the guiding surface and simultaneously reach a maxima (or a minima) of the oscillating guiding surface.

Furthermore, the ball feeding arrangement according to the present invention may advantageously be included in paintball loader, further comprising a paintball container provided with an outlet; and a drive motor for driving the ball feeding arrangement such that paintballs in the paintball container can be fed into the outlet in the paintball container.

Other objectives, features and advantages will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1:
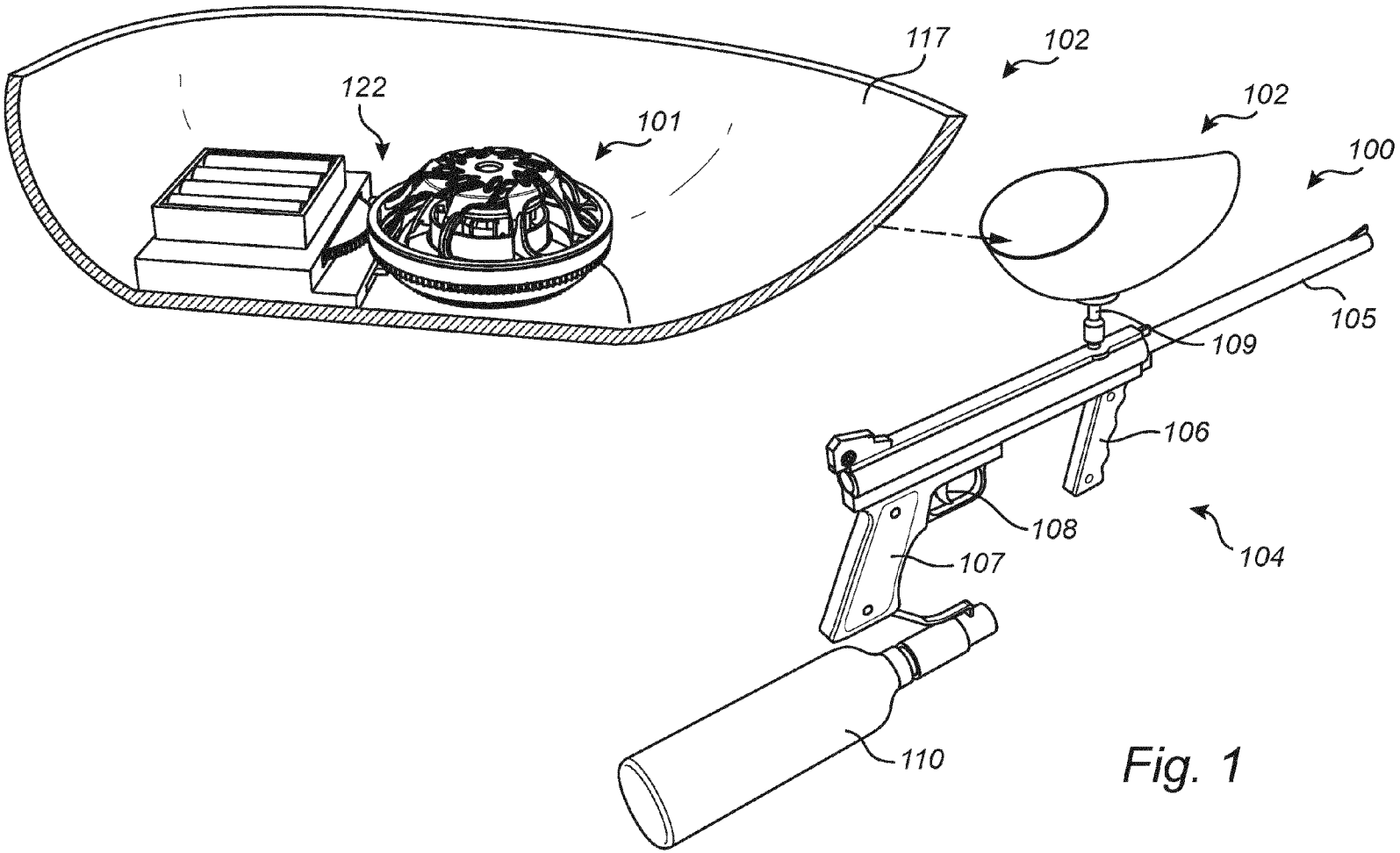
FIG. 1 is a schematic perspective view of a paintball marker equipped with a ball feeding arrangement according to an embodiment of the invention.

FIG. 1 is a schematic perspective view of a paintball marker 100 (or paintball gun) equipped with a paintball loader 102 according to an embodiment of the invention. The paintball loader comprises a paintball container 117 and a ball feeding arrangement 101 arranged inside the paintball container. The ball feeding arrangement 101 is here arranged in a lower part of the paintball container 117, and has a central outlet 103 (see FIG. 2) leading out of the paintball container. The paintball marker 100 typically includes a marker body 104 comprising a barrel 105, a front handgrip 106, a rear handgrip 107 and a trigger 108. The paintball marker 100 may also comprise an inlet tube 109 which is connected to the central outlet 103 of the ball feeding arrangement 101. The inlet tube 109 receives paintballs from the ball feeding arrangement 101 and leads to a firing chamber (not shown) in the interior of the marker body 104. Further, a drive motor 122 for driving the ball feeding arrangement can be arranged in the paintball container. There may also be a compressed gas cylinder 110 arranged at the rear end of the paintball marker 100.

Figure 2:
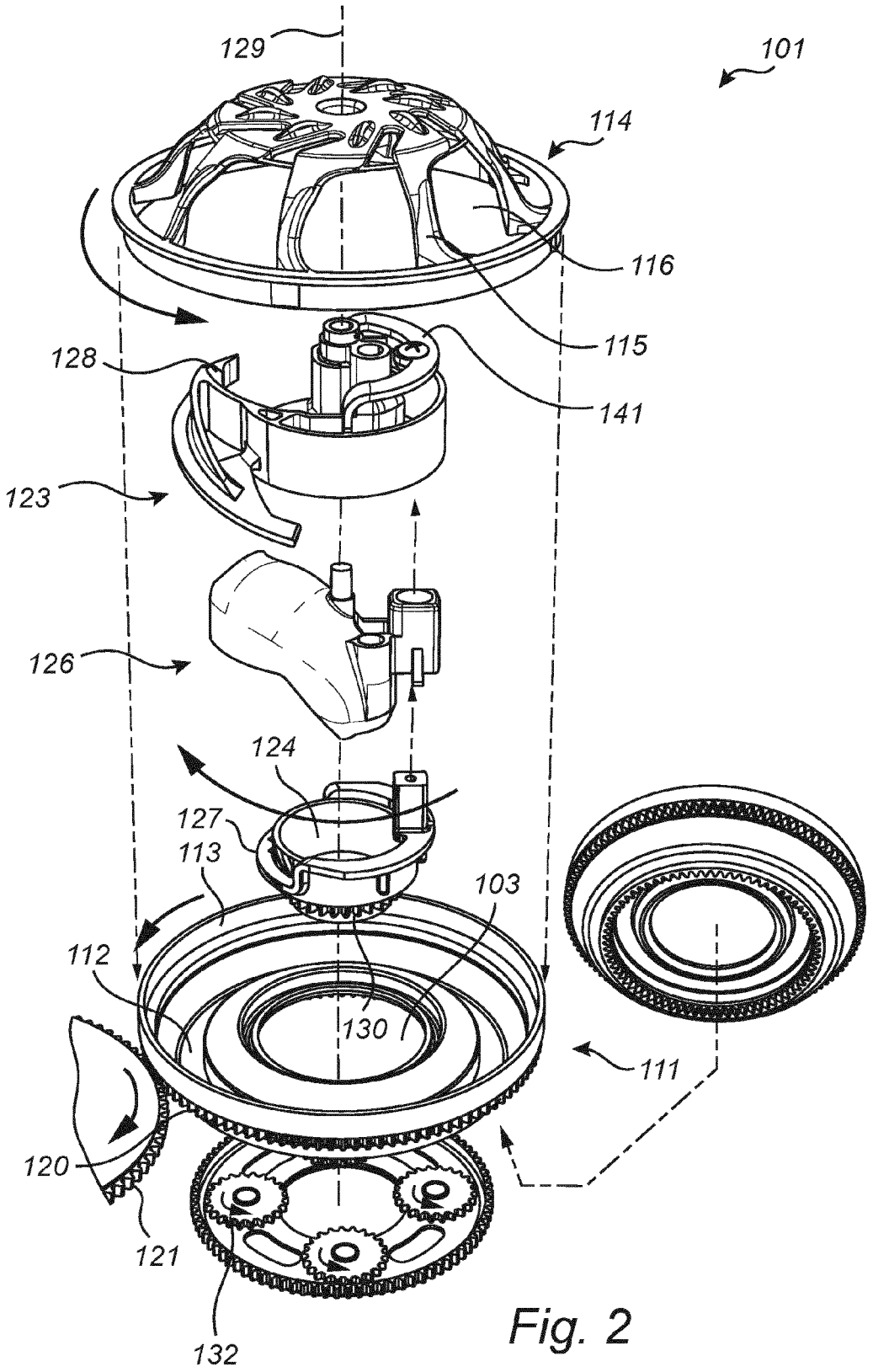
FIG. 2 is an exploded schematic perspective view of the ball feeding arrangement of FIG. 1.

FIG. 2 is an exploded schematic perspective view of the ball feeding arrangement of FIG. 1. Here, the ball feeding arrangement 101 has a rotatably arranged base part 111 comprising a bottom surface 112 enclosed by a rim 113. The ball feeding arrangement 101 also has a top part 114 arranged on top of the base part 111. The top part 114 has a plurality of rotor fins 115 extending from a centre of the top part to an outer perimeter thereof. Openings 116 between the rotor fins 115 allow paintballs in the paintball container to enter the ball feeding arrangement. The perimeter of the base part 111 can be provided with drive teeth 120 which, in assembled state, engage a transmission wheel 121 driven by the drive motor 122, such that the drive motor can rotate the base part 111 and the top part 114 about a rotational axis 129.

A rotor element 123 is rotatably arranged in the space formed between the base part 111 and the top part 114. The rotor element 123 is provided with a rotor fin 128 that extends to the perimeter of the base part 111. The rotor fin can have a rounded shape such that the paintballs are pushed towards the rotational axis 129. The rotor element 123 is here coupled to a transmission element 127 in such a way that a rotational movement of the transmission element 127 is transferred to the rotor element. The transmission element 127 is further configured to interact with a drive element 130 intended to be driven by the drive motor 122. The transmission element 127 and the drive element 130 are here provided with an opening 124 extending through the rotational axis 129 and communicating with the outlet 103 of the ball feeding arrangement. Optionally, there may also be a steering surface part 126 with a surface adapted to steer paintballs downwards into the opening 124 that communicates with the central outlet 103.

Figure 3A:
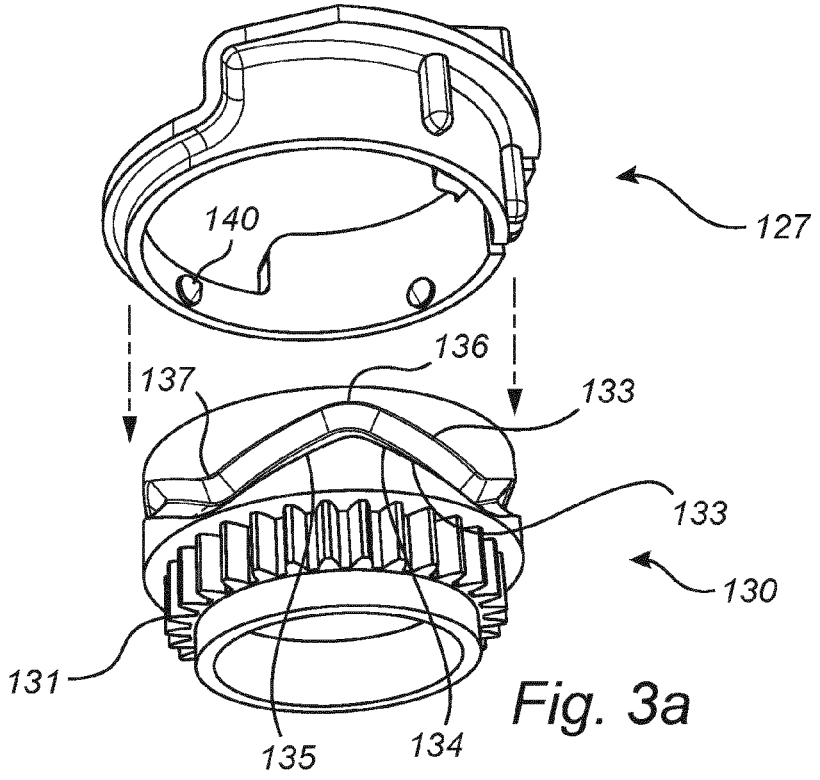
FIG. 3*a* is a schematic perspective view of the transmission element and the drive element of the ball feeding arrangement in FIG. 2.

FIG. 3*a* is a schematic perspective view of the transmission element 127 and the drive element 130. The perimeter of the drive element 130 can be provided with drive teeth 131 which, in assembled state, engage transmission wheels 132 (see FIG. 2) driven by the drive motor 122 such that the drive motor can rotate the drive element about the rotational axis 129. Further, an inner perimeter of the transmission element 127 is provided with a set of radial protrusions 140. Here, an outer perimeter of the drive element 130 is provided with a groove, or channel, such that a guiding surface 133 is formed on either side of each protrusion 140. Here, the groove forms a path that oscillates about a plane substantially perpendicular to the rotational axis 129. To allow the protrusions 140 to follow the vertical variation of the guiding surfaces 133, the transmission element 127 is vertically moveable in relation to the drive element 130. The term vertical is here intended to indicate a direction parallel to the rotational axis 129. Preferably, a resilient structure is arranged to bias the protrusions against at least one of the guiding surfaces 133. This can be achieved by yieldingly fasten the transmission element 127 in such a way such that the protrusions 140 are urged to a predetermined vertical position in relation to the guiding surfaces 133. Here this is achieved by fastening the transmission element 127 to a yielding element 141 (see FIG. 2) of the rotor element 128. The arrangement can e.g. be adapted such that the protrusions 140 are urged to a vertical centre of the oscillating groove (i.e. a vertical position located half-way in-between the maxima 136 and minima 137). Thus, during relative rotation between the drive element 130 and the transmission element 127, the protrusions will be alternately pressed against the lower guiding surface, and the upper guiding surface. It is recognized that although this embodiment utilize a guiding surface on either side of each protrusion, it may suffice with a single guiding surface. For instance, the protrusions can be biased against a guiding surface arranged beneath (or above) the protrusions.

A distance between adjacent protrusions 140 preferably corresponds to one or more complete cycles of the oscillating guiding surface 133. Here this is achieved by using three equidistantly arranged protrusions 140 and an oscillating guiding surface 133 with six cycles (i.e. the groove has six maxima 136 and six minima 137). However, as is recognized by a person skilled in the art, the number of protrusions and the number of cycles of the guiding surface may vary.

Figure 3B:
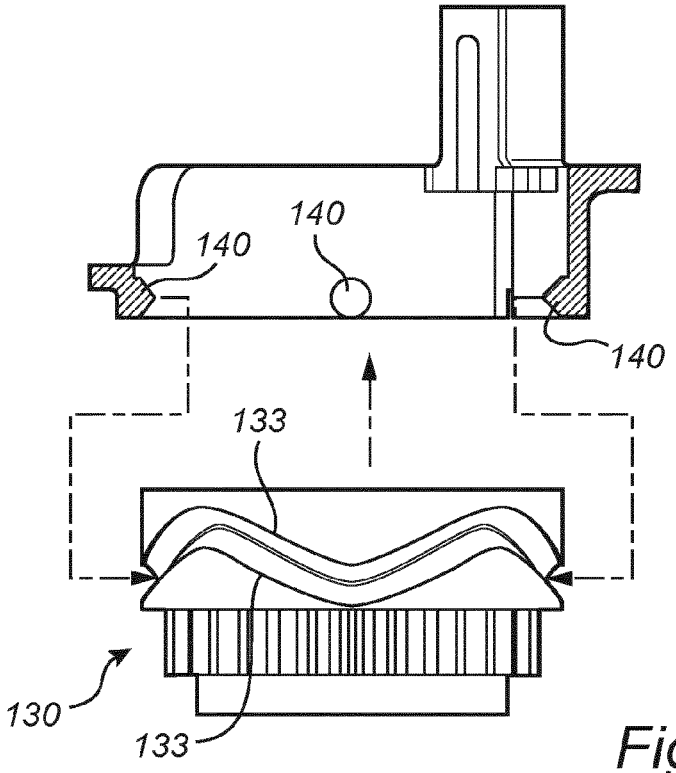
FIG. 3*b* is a side view illustrating the drive element and a cross-section of the transmission element in FIG. 2.
Figure 4A:
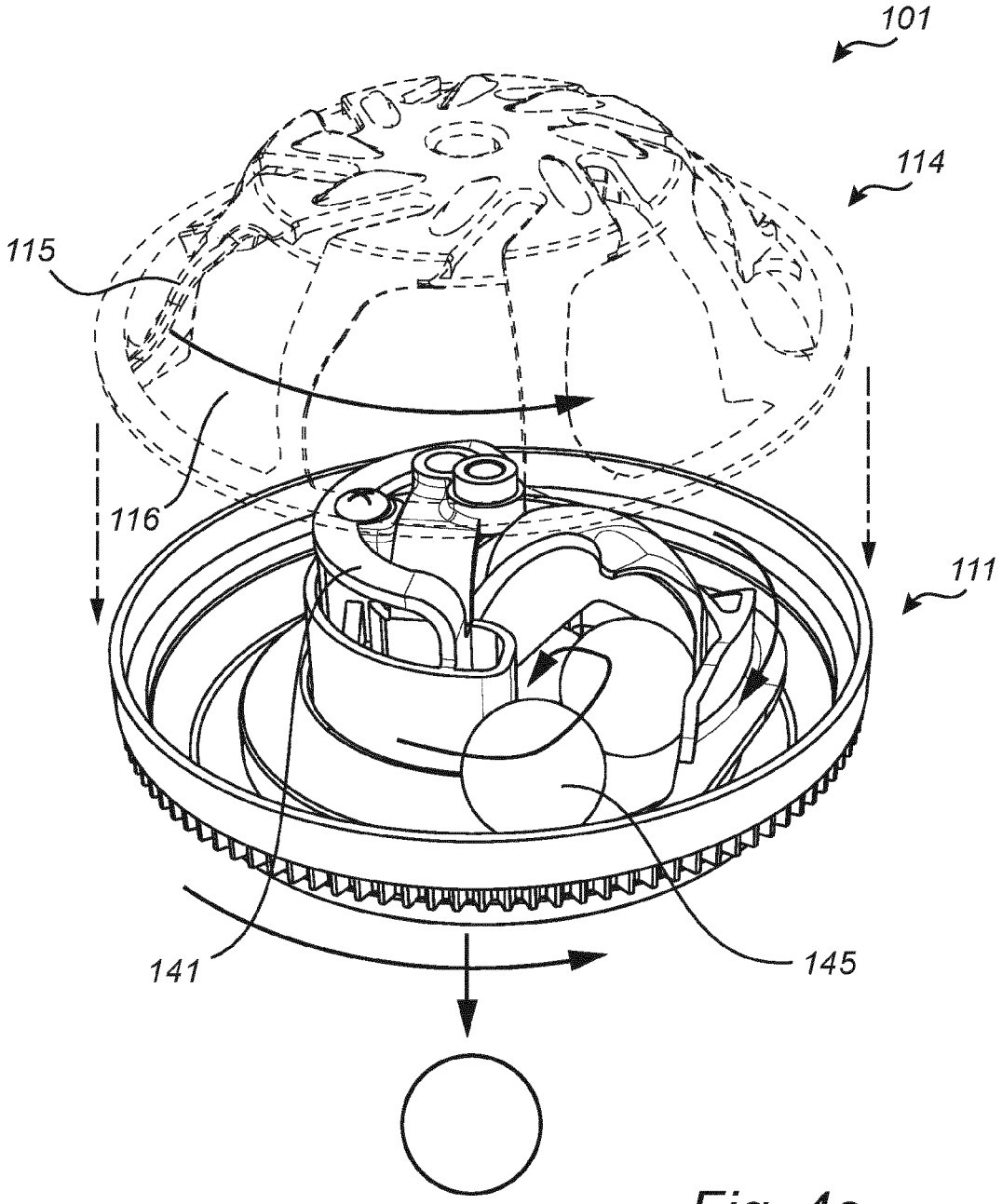
FIGS. 4*a-c* schematically illustrate operation of the ball feeding arrangement of FIG. 2.
Figure 4B:
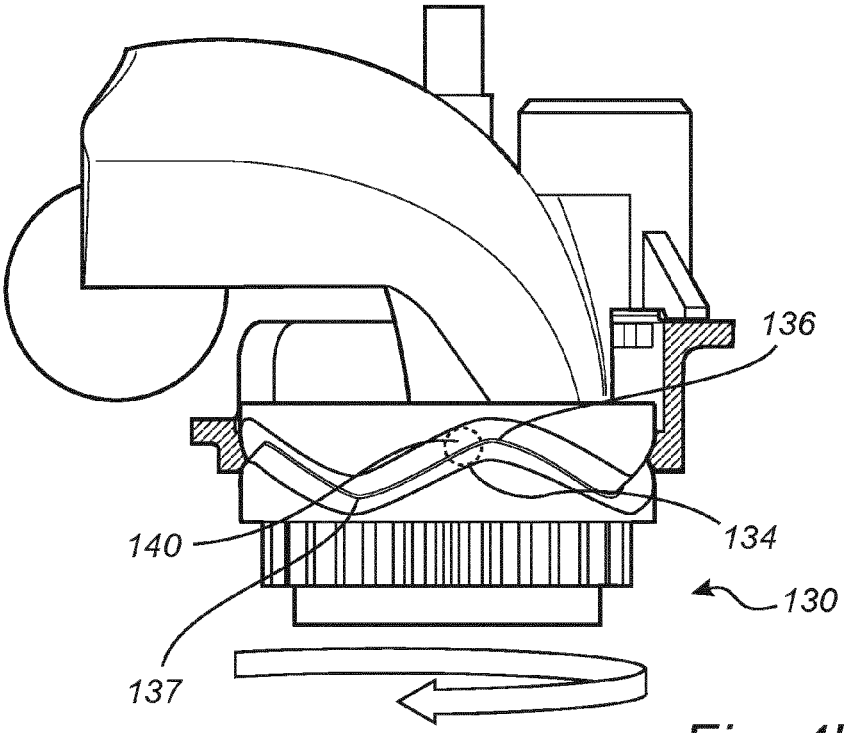
Figure 4C:
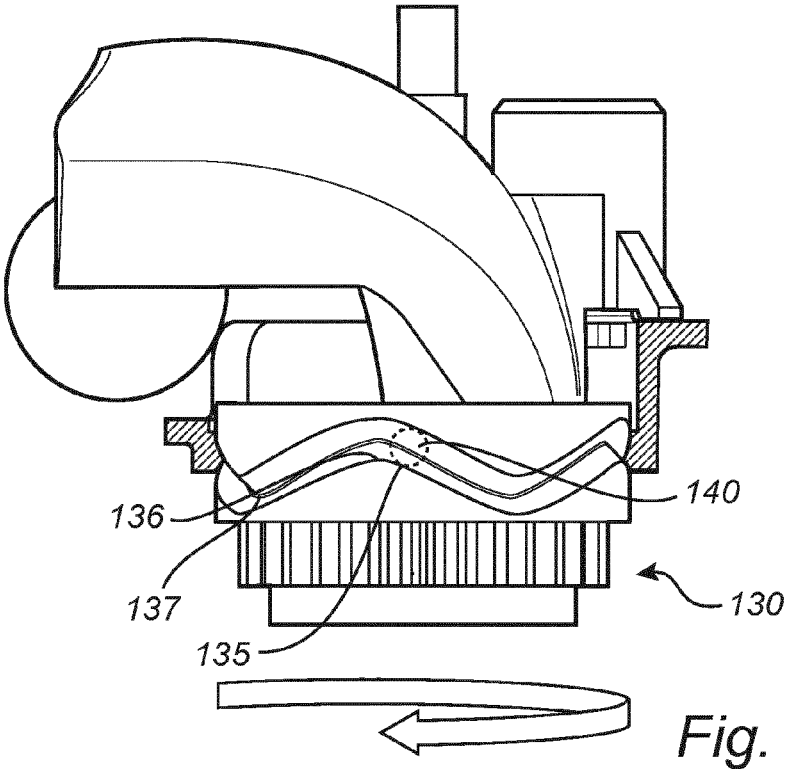

Operation of the ball feeding arrangement described in relation to FIGS. 1 to 3, will now be described with further reference to FIGS. 4*a-c*. The exemplifying rotational directions (clockwise/anti-clockwise) in the description below refer to a rotational direction as seen from above.

In operation, the drive motor 122 preferably rotates the base part 111 and the top part 114 in a first rotational direction (here anti-clockwise) such that paintballs 145 in the paintball container enters the ball feeding arrangement 101 via the openings 116 between the rotor fins 115 of the top part 114 and are pushed by the rotor fins 115 of the top part in a circular motion along the perimeter of the base part 111.

Simultaneously, the drive motor 122 rotates the drive element 130 in a second rotational direction (here clock-wise) opposite the first rotational direction. As the transmission element 127 is fastened to the vertically yielding element 141 of the rotor element 128, the transmission element 127 is urged to remain in a vertical position where the protrusions 140 are located in the vertical centre of the groove (i.e. a vertical position half-way in-between the maxima 136 and minima 137). Thus, referring to FIG. 4*b*, when the drive element 130 is rotated clock-wise, each protrusion 140 is pressed against a first surface 134 of the guiding surface 133 (here beneath the protrusion) which is inclined in such a way that the protrusion 140 is urged to move vertically (here upwards) and in the rotational direction of the drive element (here clock-wise). As long as the paintballs 145 are free to move, the rotational resistance of the rotor element 123 (and thus the rotational resistance of the transmission element) will be less than a given magnitude that is required for the vertically yielding element 141 of the rotor fin part 125 to yield, and the transmission element 127 is forced to rotate along with the drive element 130. As the rotor element 123 (and the steering surface part 126) follows the rotation of the transmission element 127, the clockwise rotation of the fin 128 of the rotor element 123 pushes the paintballs 145 towards the rotational axis 129 of the rotor element 123, where the steering surface part 126 can steer the paintballs downwards into the opening 124 that communicates with the central outlet 103.

In the event that one or more paintballs get stuck, the rotational resistance of the rotor element 123 (and the transmission element 127) is increased to a point where it exceeds the given magnitude that is required for the vertically yielding portion 141 of the rotor fin part 128 to yield.

Thus, the transmission element 127 is allowed to move vertically (here upwards) in relation to the drive element 130, such that a relative rotation between the drive element 130 and the transmission element 127 of the rotor element can occur and the protrusions 140 can be guided along the oscillating guiding surface 133. Referring to FIG. 4*c*, as the protrusions 140 passes the maxima 136 of the groove, each protrusion 140 is pressed against a second surface 135 of the guiding surface 133 (here the lower guiding surface) which is inclined in such a way that the biasing force (which is here the restoring force of the vertically yielding element 141 of the rotor element) urges the transmission element 127 to move in a direction opposite the rotational direction of the drive element 130. This causes the rotor element 123, to rotate in a rotational direction (here anti-clockwise) opposite the rotational direction of the drive element 130. Thereby, the pressure exerted by the fin 128 of the rotor element on the paintball is reduced. The change in rotational direction of the rotor element may even cause the fin 128 of the rotor element to move away from the squeezed paintball. Then, as the relative rotation between the drive element 130 and the transmission element 127 continues, each protrusion 140 will once again be pressed against a surface (here the guiding surface above the protrusion) inclined in such a way that the transmission element is urged to move in the rotational direction of the drive element (i.e. clock-wise). As long as the rotation of the rotor element 123 is blocked, the protrusions 140 will be guided along the oscillating groove and the torque transferred between the drive element and the rotor element will vary. As the pressure on the balls varies, and the rotor fin 128 occasionally is rotate away from the squeezed ball, the paintballs that are stuck can be released. Thus, a jam may be prevented, or resolved without human intervention.

Additionally, the vibrations generated when the protrusions 140 are guided along the oscillating guiding surfaces 133 can help release the paintballs that are stuck. Furthermore, the steering surface part 126 may be arranged to follow the axial (or vertical) movement of the transmission element 127. Thereby the steering surface part can push the paintball to set them free.

Figure 5:
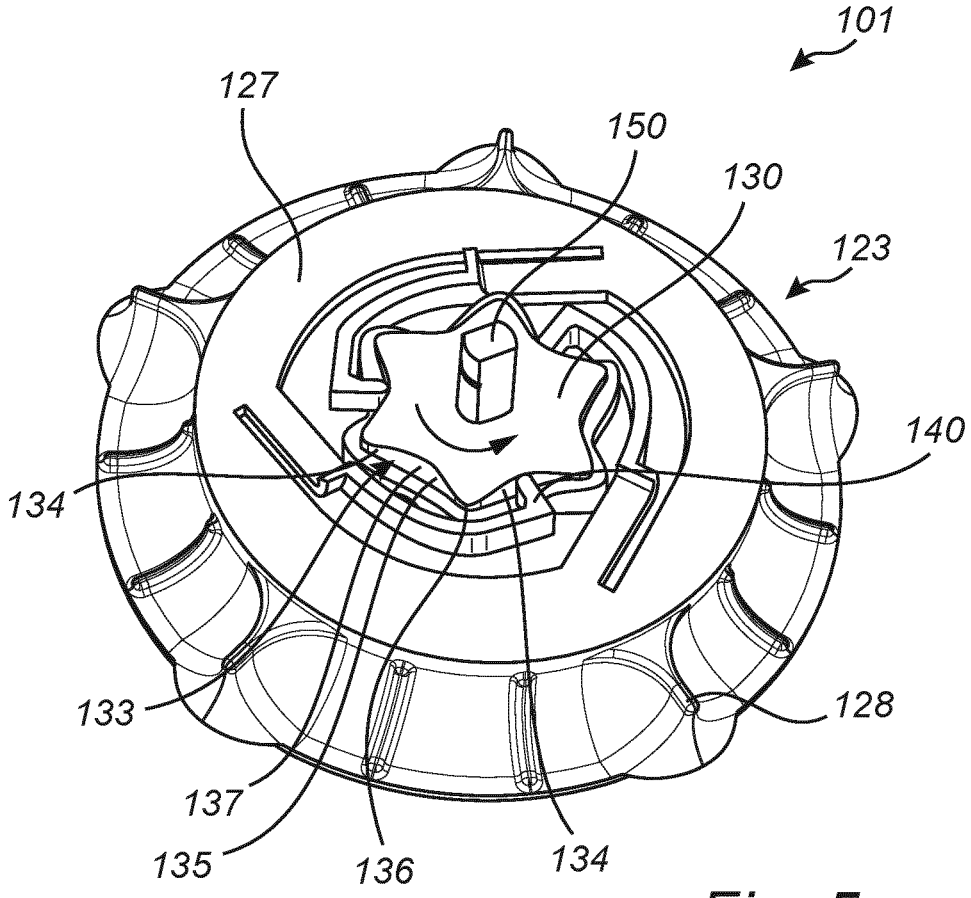
FIG. 5 schematically illustrates a ball feeding arrangement according to an alternative embodiment of the invention.

FIG. 5 illustrates a ball feeding arrangement according to an alternative embodiment of the invention. The ball feeding arrangement 101 can for example be included in a paintball loader comprising a paintball container with an outlet located in an outer wall of the paintball container, which outlet communicates with an outlet tube that leads to a firing chamber of the paintball marker. An example of such a paintball loader is described in U.S. Pat. No. 6,502,567, which is hereby incorporated by reference.

The ball feeding arrangement 101 comprises a rotor element 123 provided with fins 128 adapted to push paintballs during rotation of the rotor element. A transmission element 127 provided with a set of protrusions 140 here forms an integral part of the rotor element 123. The ball feeding arrangement 101 also comprises a drive element 130. The drive element 130 can be rotated by a drive motor (not shown) e.g. via an axle shaft 150 that is upwardly directed and coupled to a rotational centre of the drive element.

Further, a perimeter of the drive element 130 forms an oscillating guiding surface 133 adapted to guide the protrusions 140 during relative rotation between the drive element 130 and the rotor element 123. Each protrusion 140 is preferably yieldingly arranged such a portion of the protrusion is yieldingly biased against the oscillating guiding surface 133. This can be achieved by forming the protrusions, or a portion thereof, in a flexible, material such as e.g. suitable plastic, or metal.

In operation, the drive element 130 is rotated by the drive motor in a first direction (here anti-clockwise). The arrangement is such that initially, each protrusion 140 is biased against a surface 134 inclined in such a way that the protrusion 140 is urged to yield (i.e. pressed radially outwards) and the rotor element is urged to move in the rotational direction of the drive element (i.e. anti-clockwise). As long as the paintballs are free to move, the rotational resistance of the rotor element 123 will be less than a given magnitude that is required for the protrusions to yield. Consequently, the rotor element 123 is forced to rotate along with the drive element 130. During rotation of the rotor element 123, the paintballs are pushed by the fins 128 and are consequently pressed forward and outward from the rotational centre by the centrifugal force, such that the paintballs can be pushed into the opening of the outlet tube and into the paintball marker.

In the event that one or more paintballs get stuck, the rotational resistance of the rotor element 123 is increased to a point where it exceeds the given magnitude that is required for the protrusions to yield. Thereby, the protrusions are pressed radially outwards and a relative rotation between the drive element 130 and the rotor element 123 is allowed and the protrusions 140 are guided along the oscillating guiding surface 133. When each of the protrusions 140 passes a respective maxima 136 of the oscillating guiding surface, each protrusion 140 is pressed radially inwards against a surface 135 which is inclined in such a way that the biasing force (which is here the restoring force of the protrusion 140) urge the rotor element to rotate in a direction opposite the rotational direction of the drive element. As the rotor element 123 is caused to rotate in a rotational direction (here clockwise) opposite the rotational direction of the drive element 130, the pressure exerted by the fins 128 of the rotor element on the paintballs is reduced, and the fins 128 may even move away from the squeezed paintballs. Then, as the relative rotation between the drive element 130 and the rotor element 123 continues, each protrusion 140 will once again (after passing a respective minima 137) be pressed against a surface 134 inclined in such a way that the rotor element 123 is urged to move in the rotational direction of the drive element (i.e. anticlock-wise).

As long as rotation of the rotor element 123 is blocked, the protrusions 140 will be guided along the oscillating guiding surface 133 and the torque transferred between the drive element and the rotor element will vary. As the pressure on the balls varies and the fin 128 occasionally is rotated away from the squeezed ball, the paintballs that are stuck can be released. Thus, a jam may be prevented, or resolved without human intervention.

Figure 6:
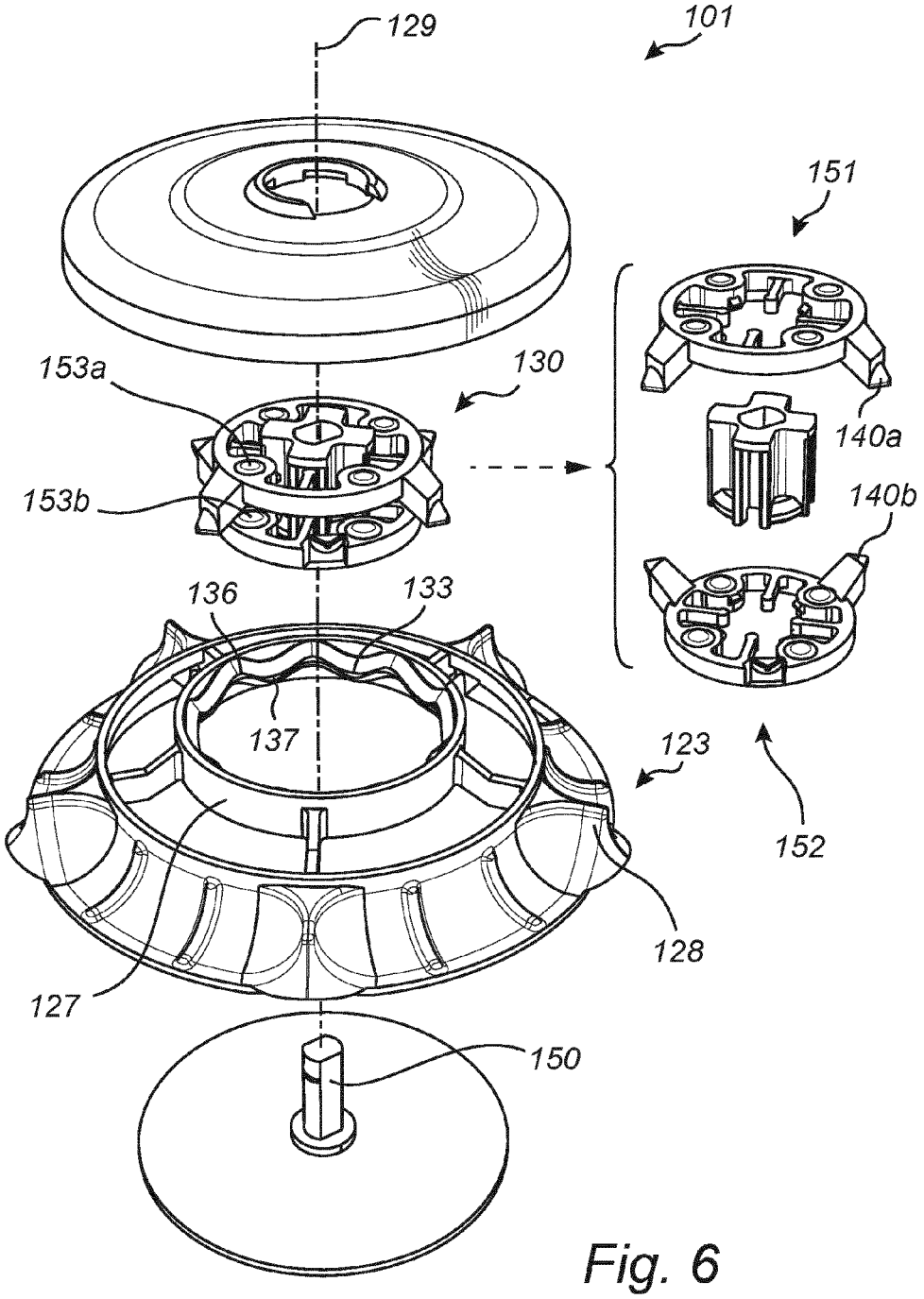
FIGS. 6 and 7 schematically illustrate a ball feeding arrangement according to yet another alternative embodiment of the invention.

FIG. 6 illustrates a ball feeding arrangement according an alternative embodiment of the invention. The ball feeding arrangement 101 can for example be included in a paintball loader comprising a paintball container having an outlet located in an outer wall of the paintball container, which outlet communicates with an outlet tube that leads to a firing chamber of the paintball marker.

The ball feeding arrangement 101 comprises a rotor element 123 provided with fins 128 adapted to push paintballs during rotation of the rotor element. A transmission element 127 here forms an integral part of the rotor element 123. The transmission element here comprise a ring-shaped rail, where an upper side and a lower side of the rail form an upper guiding surface 133 and a lower guiding surface, respectively.

Figure 7:
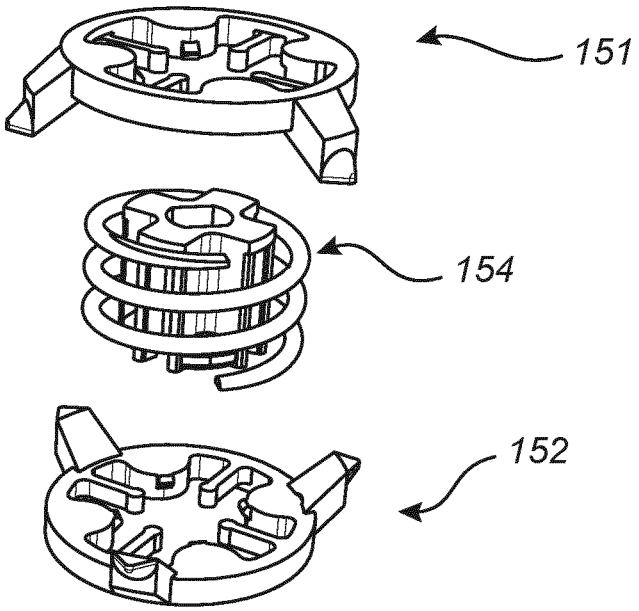

The ball feeding arrangement 101 also comprises a drive element 130. The drive element 130 can be rotated by a drive motor e.g. via an axle shaft 150 that is upwardly directed and coupled to a rotational centre of the drive element. The drive element 130 is provided with a set of protrusions. Here, the set of protrusions includes a first subset of protrusions 140*a* arranged on an upper structure 151 of the drive element, and a second subset of protrusions 140*b* arranged on a lower structure 152 of the drive element. The protrusions 140*a* on the upper structure 151 are adapted to abut on the lower guiding surface (i.e. on a lower side of the rail), whereas the protrusions 140*b* on the lower structure 152 are adapted to abut on an upper guiding surface (i.e. on an upper side of the rail). Further, the upper and lower structures are moveable in relation to each other in a vertical direction (i.e. in a direction parallel with the rotational axis 129), and configured to repel each other such that the protrusions 140*a*,140*b* are biased against their respective guiding surface 133. The repelling force can be achieved by arranging repelling magnetic elements 153*a*,153*b* in the upper and lower structures. As an alternative or a complement, the repelling force may be achieved by arranging one or more resilient elements 154, such as a coil spring, between the upper and lower structures (as exemplified in FIG. 7).

The distance between adjacent protrusions 140*a* in the upper structure 151 preferably corresponds to one or more complete cycles of the oscillating guiding surface 133. Similarly, the distance between adjacent protrusions 140*b* in the lower structure preferably corresponds to a one or more complete cycles of the oscillating guiding surface. Further, the upper 151 and lower 152 structures of the drive element are arranged such that they alternately move away from each other and towards each other, during relative rotation between the drive element 130 and the rotor element 123. This can be achieved by separating (or shifting) the protrusions 140*a* in the upper structure and the protrusions 140*b* in the lower structure by a half cycle of the oscillating rail, such that when the protrusions 140*a* on the upper structure are at a respective maxima 136, the protrusions 140*b* on the lower structure are at a respective minima 137, and vice versa.

Here this is achieved by using an oscillating guiding surface 133 with nine cycles. (i.e. the rail has nine maxima 136 and nine minima 137), combined with three equidistantly arranged protrusions 140*a* on the upper structure 151, and three equidistantly arranged protrusions on the lower structure 152, where the protrusions 140*a* on upper structure are arranged halfway in-between the protrusions 140*b* on the lower structure. However, as is recognized by a person skilled in the art, the number of protrusions and the number of cycles of the guiding surfaces may vary.

Figure 8A:
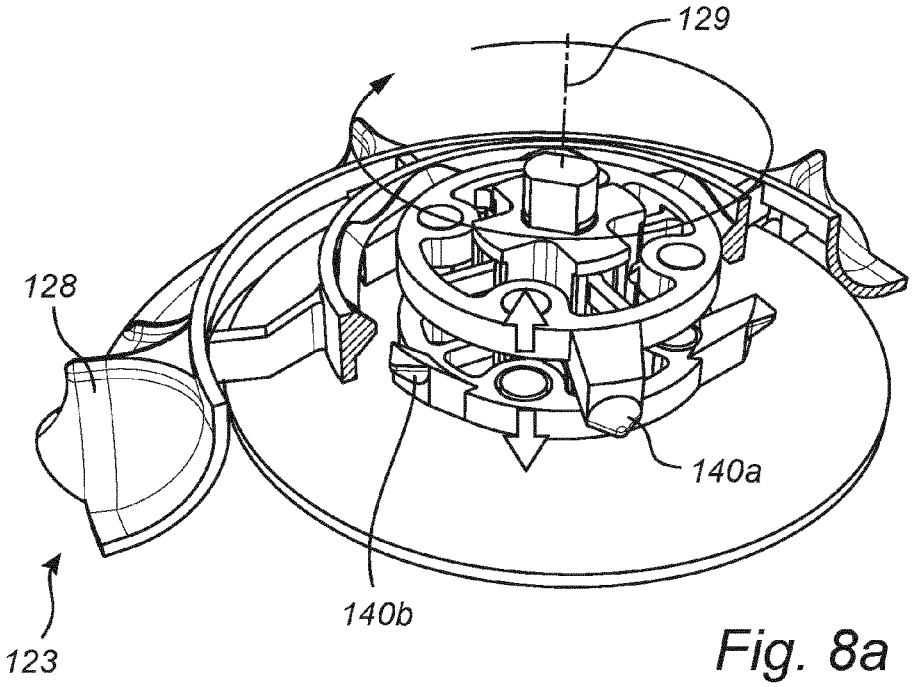
FIGS. 8*a-b* schematically illustrate operation of the ball feeding arrangement of FIG. 6.
Figure 8B:
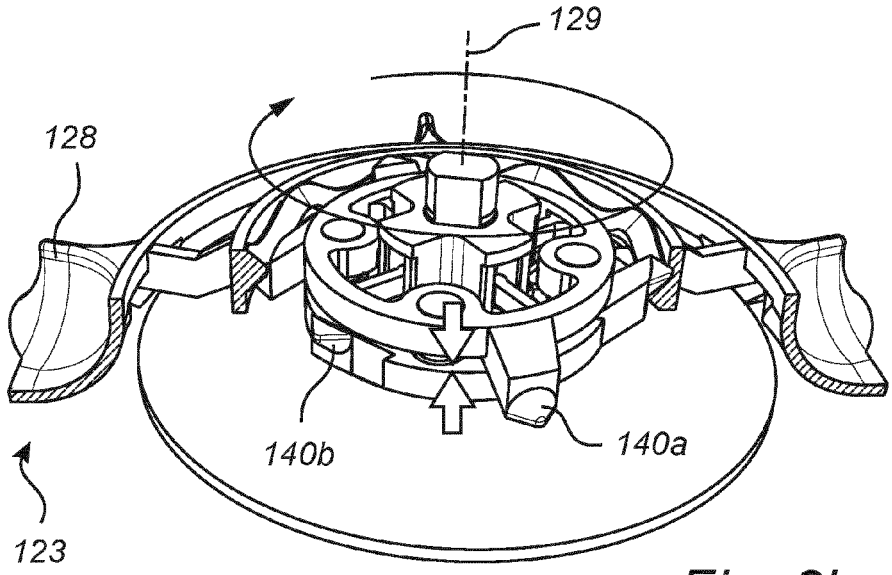

Operation of the ball feeding arrangement of FIG. 6, will now be described with further reference to FIGS. 8*a-b*. In operation, the drive element 130 is rotated by the drive motor in a first direction (here clockwise). As long as the paintballs are free to move, the rotational resistance of the rotor element 123 will be less than a given magnitude that is required for the repelling force of the magnetic elements 153*a*,153*b* to yield. Thus, the protrusions 140*a* on the upper structure, which abut on the lower guiding surface, will be located near a maxima 136, whereas the protrusions 140*b* on the lower structure, which abut on the upper guiding surface, will be located near a minima 337 (as illustrated in FIG. 8*a*). Thereby each protrusion 140*a*,140*b* is pressed against a surface inclined in such a way that the rotor element 123 is urged to move in the rotational direction of the drive element (i.e. clockwise) and the rotor element 123 is forced to rotate along with the drive element 130. During rotation of the rotor element 123, the paintballs are pushed by the fins 128 and are consequently pressed forward and outward from the rotational centre by the centrifugal force, such that the paintballs can be pushed into the opening of the outlet tube and into the paintball marker.

In the event that one or more paintballs get stuck, the rotational resistance of the rotor element 123 is increased to a point where it exceeds the given magnitude that is required for the repelling force between the upper 151 and lower 152 structures to yield. Consequently, the upper 151 and lower 152 structures are allowed to move vertically towards each other (as illustrated in FIG. 8*b*), such that a relative rotation between the drive element 130 and the rotor element 123 can occur and the protrusions 140*a*,140*b* can be guided along the oscillating guiding surfaces 133. As each protrusion 140*a* of the upper structure, which abut on the lower guiding surface, passes a respective minima 137, and each protrusion 140*b* of the lower structure, which abut on the upper guiding surface, passes a respective maxima 136, the inclination of the both guiding surfaces 133 is reversed and each protrusion 140*a*, 140*b* is pressed against a surface which is inclined in such a way that the biasing force (which is here the repelling force between the upper and lower structures) urge the rotor element to rotate in a rotational direction opposite the rotational direction of the drive element. This causes the rotor element 123 to rotate in a rotational direction (here anti-clockwise) opposite the rotational direction of the drive element. Thereby, the pressure exerted by the fins 128 of the rotor element on the paintballs is reduced, and the fins may even move away from the squeezed paintballs. Then, as the relative rotation between the drive element and the rotor element continues, each protrusion 140*a* on the upper structure (which abut on the lower guiding surface) reach a maxima 136, and each protrusion 140*b* on the lower structure (which abut on the upper structure) reach a minima 137, such that each protrusion 140*a*,140*b* will once again be pressed against a surface inclined in such a way that the rotor element is urged to move in the rotational direction of the drive element (i.e. clock-wise).

As long as the rotation of the rotor element 123 is blocked, the protrusions 140*a*,140*b* will be guided along the oscillating guiding surfaces and the torque transferred between the drive element and the rotor element will vary. As the pressure on the paintballs varies and the rotor fin 128 occasionally is rotated away from the squeezed ball, the paintballs that are stuck can be released. Thus, a jam may be prevented, or resolved without human intervention.

Figure 9:
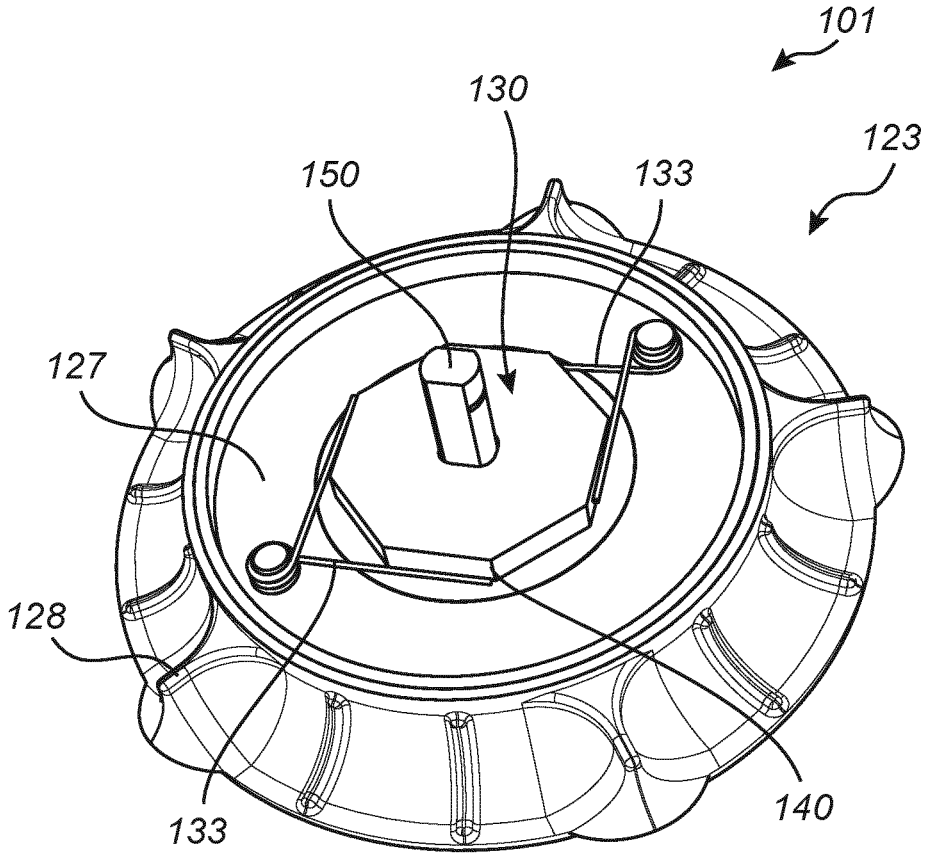
FIG. 9 schematically illustrates a ball feeding arrangement according to yet another embodiment of the invention.

FIG. 9 is a schematic perspective view of yet another embodiment of a ball feeding arrangement. In this embodiment, the drive element 130 is shaped as an octagon, and the transmission element 127 includes two helical torsion springs made of a wire of metal or other suitable material. The helical torsion springs are here arranged in such a way that the portions of the wire that extends from the coil of each torsion spring are yieldingly biased against the perimeter of the drive element. Thus, the corners 140 of the octagonal drive element form a set of protrusions, and the portions of the wire that extend from the coils of the torsion springs form a guiding surface 133.

As long as the paintballs are free to move, the rotational resistance of the rotor element 123 will be less than a given magnitude that is required for the torsion spring to yield, and the rotor element 123 will be forced to rotate along with the drive element 130, whereby the paintballs can be pushed by the fins 128 of the rotor element.

However, in the event that one or more paintballs get stuck, the rotational resistance of the rotor element 123 is increased to a point where it exceeds the given magnitude that is required for the torsion springs to yield. This will cause a relative rotation between the drive element 130 and the transmission element 127. During relative rotation there will occasionally be a pressure generated between the octagonal drive element 130 and the wires of the torsion springs that urges the transmission element 127 to rotate in a rotational direction opposite a rotational direction of the drive element 130. It is recognized that the same effect may be achieved for drive element of other shapes, such as other polygonal shapes e.g. a tetragon or hexagon.

The invention has mainly been described above with reference to a few embodiments. However, as is readily appreciated by a person skilled in the art, other embodiments than the ones disclosed above are equally possible within the scope of the invention, as defined by the appended claims. For instance, the transmission element and the rotor element do not necessarily rotate about a common rotational axis. Instead, the rotational force may be transferred from the transmission element to the rotor element by means of e.g. a transmission belt, or cog wheels which engage to transfer the rotational force. This allows the drive element and transmission element to be provided in a unit which is separate from the rotor element. Further, although the ball feeding arrangement is here described for use in a paintball loader it may also be utilized in other applications. For example, it may be used in other compressed gas driven weapons where rapid uninterrupted fire is desirable. It may also be used for feeding balls in an industrial process.

The invention claimed is:

1. A ball feeding arrangement comprising:

a rotor element for pushing a ball;

a transmission element connected to said rotor element; and a drive element for driving a rotational movement of said rotor element via said transmission element, said drive element configured to be driven by a drive motor, wherein one of said drive element and said transmission element has at least one protrusion, and the other of said drive element and said transmission element has an oscillating guiding surface adapted to guide the at least one protrusion during relative rotation between said drive element and said transmission element, wherein said at least one protrusion is yieldingly biased against said guiding surface, wherein the biasing force, a shape of said guiding surface and a shape of said at least one protrusion are adapted to enable transfer of a rotational force of a given magnitude from said drive element to said transmission element such that a relative rotation between said drive element and said transmission element occurs when said rotor element is subject to a rotational resistance greater than said given magnitude, wherein the biasing force, a shape of said guiding surface and a shape of said at least one protrusion are further adapted such that, occasionally during relative rotation between said drive element and said transmission element, a pressure is generated between said at least one protrusion and said guiding surface that urges said transmission element to rotate in a rotational direction opposite a rotational direction of the drive element.

2. The ball feeding arrangement according to claim 1, wherein said guiding surface includes at least one first surface inclined in such a way that rotation of said drive element generates a pressure between said at least one protrusion and said at least one first surface that urges said transmission element to rotate in the rotational direction of the drive element.

3. The ball feeding arrangement according to claim 2, wherein said guiding surface includes at least one second surface inclined in such a way that the biasing force generates a pressure between said at least one protrusion and said at least one second surface that urges the transmission element to rotate in a rotational direction opposite the rotational direction of the drive element.

4. The ball feeding arrangement according to claim 3, wherein said at least one first surface and said at least one second surface are arranged in such a way that the at least one protrusion alternately are biased against one of said first surfaces and one of said second surfaces during relative rotation between said drive element and said transmission element.

5. The ball feeding arrangement according to claim 1, further comprising a resilient structure arranged to yieldingly bias said at least one protrusion against said guiding surface.

6. The ball feeding arrangement according to claim 1, wherein said guiding surface has a variation in a direction substantially parallel to the rotational axis.

7. The ball feeding arrangement according to claim 1, wherein said guiding surface is such that a distance to the rotational axis varies along the guiding surface.

8. The ball feeding arrangement according to claim 1, wherein said transmission element and said drive element are rotatable about a common rotational axis.

9. The ball feeding arrangement according to claim 1, wherein said rotor element and said transmission element are rotatable about a common rotational axis.

10. The ball feeding arrangement according to claim 1, wherein said transmission element is an integral part of the rotor element.

11. The ball feeding arrangement according to claim 1, wherein said guiding surface forms a closed path.

12. The ball feeding arrangement according to claim 1, wherein the at least one protrusion includes adjacent protrusions, wherein a distance between the adjacent protrusions corresponds to one or more complete cycles of the oscillating guiding surface.

13. A paint ball loader, comprising:

a paintball container provided with an outlet;

a ball feeding arrangement according to claim 1, for feeding paintballs in said paintball container into said outlet; and a drive motor for driving said ball feeding arrangement.

* * * * *